US009657616B2

(12) United States Patent
Kimura et al.

(10) Patent No.: US 9,657,616 B2
(45) Date of Patent: May 23, 2017

(54) MUFFLER SOUND-INSULATION STRUCTURE

(71) Applicant: Kobe Steel, Ltd., Hyogo (JP)

(72) Inventors: Yasumasa Kimura, Kobe (JP); Yosuke Fukushima, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/888,127

(22) PCT Filed: Mar. 26, 2014

(86) PCT No.: PCT/JP2014/058676
§ 371 (c)(1),
(2) Date: Oct. 30, 2015

(87) PCT Pub. No.: WO2014/181596
PCT Pub. Date: Nov. 13, 2014

(65) Prior Publication Data

US 2016/0061075 A1 Mar. 3, 2016

(30) Foreign Application Priority Data

May 7, 2013 (JP) ..... 2013-097805

(51) Int. Cl.
*F01N 1/24* (2006.01)
*F01N 13/14* (2010.01)
(Continued)

(52) U.S. Cl.
CPC ..... *F01N 1/24* (2013.01); *F01N 13/007* (2013.01); *F01N 13/1894* (2013.01);
(Continued)

(58) Field of Classification Search
CPC ..... F01N 1/24; F01N 13/141; F01N 13/146; F01N 13/1888; F16L 59/02; F16L 59/025; F16L 59/027
(Continued)

(56) References Cited

U.S. PATENT DOCUMENTS 2,759,491 A * 8/1956 Everhart ..... F16L 9/18 138/111
2,834,427 A * 5/1958 Powers ..... F01N 13/14 181/243
(Continued)

FOREIGN PATENT DOCUMENTS

GB 748943 A * 5/1956 ..... F01N 1/10
GB 2129490 A * 5/1984 ..... F01N 13/16
(Continued)

OTHER PUBLICATIONS

International Search Report and Written Opinion from PCT/JP2014/058676 dated Jun. 3, 2014.

*Primary Examiner* — Edgardo San Martin
(74) *Attorney, Agent, or Firm* — Studebaker & Brackett PC

(57) ABSTRACT

A soundproof cover (30) is equipped with: multiple unit soundproof covers (31R, 31L) forming a portion of the circumferential cross section (30*s*); and connecting parts (35) provided on the periphery of the circumferential cross section (30*s*), and connecting the multiple unit soundproof covers (31R, 31L) in a detachable manner. The multiple unit soundproof covers (31R, 31L) are configured so as to be capable of being attached and detached with respect to a muffler (20) by moving the unit covers in a direction (the radial direction (R)) orthogonal to the axial direction (A) of the muffler (20).

10 Claims, 11 Drawing Sheets

(51) Int. Cl.

| | |
|---|---|
| ***F01N 13/18*** | (2010.01) |
| ***F16L 59/02*** | (2006.01) |
| ***F01N 13/00*** | (2010.01) |
| ***F04B 39/00*** | (2006.01) |
| *F01N 1/00* | (2006.01) |
| *F16L 59/00* | (2006.01) |
| *F04D 29/66* | (2006.01) |
| *F04C 29/06* | (2006.01) |
| *F04C 18/16* | (2006.01) |

(52) U.S. Cl.
CPC ..... *F04B 39/0061* (2013.01); *F01N 2470/18* (2013.01); *F01N 2470/24* (2013.01); *F04C 18/16* (2013.01); *F04C 29/065* (2013.01); *F04D 29/661* (2013.01)

(58) Field of Classification Search
USPC ..... 181/252, 247, 248, 256, 241, 243, 205, 181/200
See application file for complete search history.

(56) References Cited

U.S. PATENT DOCUMENTS 2,966,226 A * 12/1960 Kalis ..... F01N 13/1855 138/99
3,233,699 A * 2/1966 Plummer ..... F01N 13/14 138/141
3,491,849 A * 1/1970 Newkirk ..... F02B 77/13 181/204
3,848,897 A * 11/1974 McClellan ..... F16L 59/121 248/56
3,963,087 A * 6/1976 Grosseau ..... B60K 13/04 180/309
4,026,381 A * 5/1977 Conley ..... F01N 1/24 181/244
4,219,173 A * 8/1980 Forbes ..... F16L 5/04 248/56
4,258,821 A * 3/1981 Wendt ..... F04D 29/664 181/202
4,487,289 A * 12/1984 Kicinski ..... F01N 1/08 181/252
4,585,091 A * 4/1986 Budd ..... F01N 13/18 137/15.08
4,598,790 A 7/1986 Uesugi et al.
RE32,258 E * 10/1986 Kondo ..... B01D 53/944 29/235
4,880,078 A * 11/1989 Inoue ..... F01N 1/02 181/217
5,024,289 A * 6/1991 Merry ..... F01N 13/14 181/231
5,272,285 A * 12/1993 Miller ..... F04B 39/0033 181/202
5,464,952 A * 11/1995 Shah ..... B29C 70/088 180/89.2
5,590,524 A * 1/1997 Moore, III ..... F01N 13/102 181/240
5,681,072 A * 10/1997 Stricker ..... B60R 13/0838 181/205
5,777,947 A * 7/1998 Ahuja ..... A47H 23/08 181/256
5,974,784 A * 11/1999 Feldman ..... B01D 53/94 165/185
6,082,488 A * 7/2000 Lin ..... F01N 1/10 181/256
6,098,744 A * 8/2000 Kawamura ..... B65D 90/06 181/198
6,152,260 A * 11/2000 Eipper ..... B29C 44/184 181/252
6,520,285 B2 * 2/2003 Tobias ..... F01N 1/24 181/227
6,530,443 B1 * 3/2003 Tsuruta ..... F01N 13/08 180/89.2
6,543,577 B1 * 4/2003 Ferreira ..... F01N 1/24 181/243
6,668,972 B2 * 12/2003 Huff ..... B60K 13/04 181/228
6,722,466 B1 * 4/2004 Tong ..... E04B 1/8218 181/200
6,766,879 B2 * 7/2004 Eilers ..... A47J 42/38 181/198
6,932,190 B2 * 8/2005 Sishtla ..... F16L 55/0336 181/202
7,325,652 B2 * 2/2008 Huff ..... B60R 19/48 181/209
7,357,219 B2 * 4/2008 Mafi ..... F24F 1/12 181/200
7,398,855 B2 * 7/2008 Seel ..... F01C 21/10 181/200
7,434,656 B2 * 10/2008 Yasuda ..... F01N 1/24 181/207
8,905,188 B2 * 12/2014 Park ..... F01N 13/00 181/241
2006/0124387 A1 6/2006 Berbner et al.
2008/0006478 A1 * 1/2008 Dreyer ..... F16L 55/0336 181/205
2008/0230307 A1 9/2008 Matsumoto et al.
2010/0287919 A1 * 11/2010 Yamagiwa ..... B60K 13/04 60/320

FOREIGN PATENT DOCUMENTS

| | | | |
|---|---|---|---|
| JP | S52-019006 | U | 2/1977 |
| JP | S52-160030 | | 12/1977 |
| JP | S57-192597 | U | 12/1982 |
| JP | S58-016310 | U | 2/1983 |
| JP | S59-135317 | U | 9/1984 |
| JP | S61-151017 | U | 9/1986 |
| JP | S61-294115 | A | 12/1986 |
| JP | S64-004816 | U | 1/1989 |
| JP | H04-026897 | A | 1/1992 |
| JP | H04-059325 | U | 5/1992 |
| JP | H07-019021 | A | 1/1995 |
| JP | H07-180526 | A | 7/1995 |
| JP | 2006-519710 | A | 8/2006 |
| JP | 2008-232053 | A | 10/2008 |
| JP | 2011-074914 | A | 4/2011 |
| JP | 2011-256857 | A | 12/2011 |
| WO | 85/05404 | A1 | 12/1985 |

* cited by examiner

MUFFLER SOUND-INSULATION STRUCTURE

TECHNICAL FIELD

The present invention relates to a muffler sound-insulation structure which insulates noise of a muffler.

BACKGROUND ART

Conventionally, there have been mufflers which reduce noise of fluids (for example, Patent Documents 1 and 2). In the techniques described in the Patent Documents 1 and 2, a cover is provided outside a pipe. There have also conventionally been those provided with a soundproof cover covering a muffler (a muffler sound-insulation structure) outside the muffler. According to this structure, noise of a muffler is insulated by the soundproof cover.

CITATION LIST

Patent Document

Patent Document 1: JP 2008-232053 A
Patent Document 2: JP 2011-074914 A

SUMMARY OF THE INVENTION

Technical Problems

When an inspection, a repair or the like for a muffler sound-insulation structure is conducted, a soundproof cover may be detached from a muffler. After the inspection, the repair or the like, the soundproof cover may be attached to the muffler. In conventional muffler sound-insulation structures, the attachment or the detachment has been difficult in some cases, which has resulted in a concern that an ease of maintenance of a muffler sound-insulation structure is lowered.

Thus, the present invention has an object of providing a muffler sound-insulation structure capable of ensuring a sound insulation performance and the ease of maintenance.

Solution to Problems

The muffler sound-insulation structure of the present invention comprises a muffler having an axial direction, through which a fluid flows inside, and a soundproof cover which encloses the muffler in a state of non-contact to the muffler. The soundproof cover is formed so as to have a circumferential cross section when viewed from the axial direction, and is configured to be disassemblable. The soundproof cover comprises plural unit soundproof covers each constituting a portion of the circumferential cross section, and connecting parts which are provided on the periphery of the circumferential cross section, connecting the plural unit soundproof covers with one another in an attachable/detachable manner. Each of the plural unit soundproof covers is configured so as to be capable of being attached and detached relative to the muffler by being moved in a direction orthogonal to the axial direction of the muffler.

Effects of the Invention

With the above structure, it is possible to ensure a sound insulation performance and an ease of maintenance.

BRIEF DESCRIPTION OF DRAWINGS

FIG. 2 (*b*) is a cross-sectional view taken along an arrow IIb in FIG. 2 (*a*).

FIG. 5 (*b*) is a cross-sectional view taken along an arrow Vb in FIG. 5 (*a*), which is a view of the second embodiment corresponding to FIG. 2 (*b*).

FIG. 6 (*b*) is a cross-sectional view taken along an arrow VIb in FIG. 6 (*a*), which is a view of the third embodiment corresponding to FIG. 2 (*b*).

FIG. 7 (*b*) is a cross-sectional view taken along an arrow VIIb in FIG. 7 (*a*), which is a view of the fourth embodiment corresponding to FIG. 2 (*b*).

FIG. 8 (*b*) is a cross-sectional view taken along an arrow VIIIb in FIG. 8 (*a*), which is a view of the fifth embodiment corresponding to FIG. 2 (*b*).

FIG. 10 (*b*) is a cross-sectional view taken along an arrow Xb in FIG. 10 (*a*), which is a view of the sixth embodiment corresponding to FIG. 2 (*b*).

FIG. 11 (*b*) is a cross-sectional view taken along an arrow XIb in FIG. 11 (*a*), which is a view of the seventh embodiment corresponding to FIG. 2 (*b*).

DESCRIPTION OF EMBODIMENTS

First Embodiment

A muffler sound-insulation structure 1 of a first embodiment will be described with reference to FIG. 1 to FIG. 4.

Figure 1:
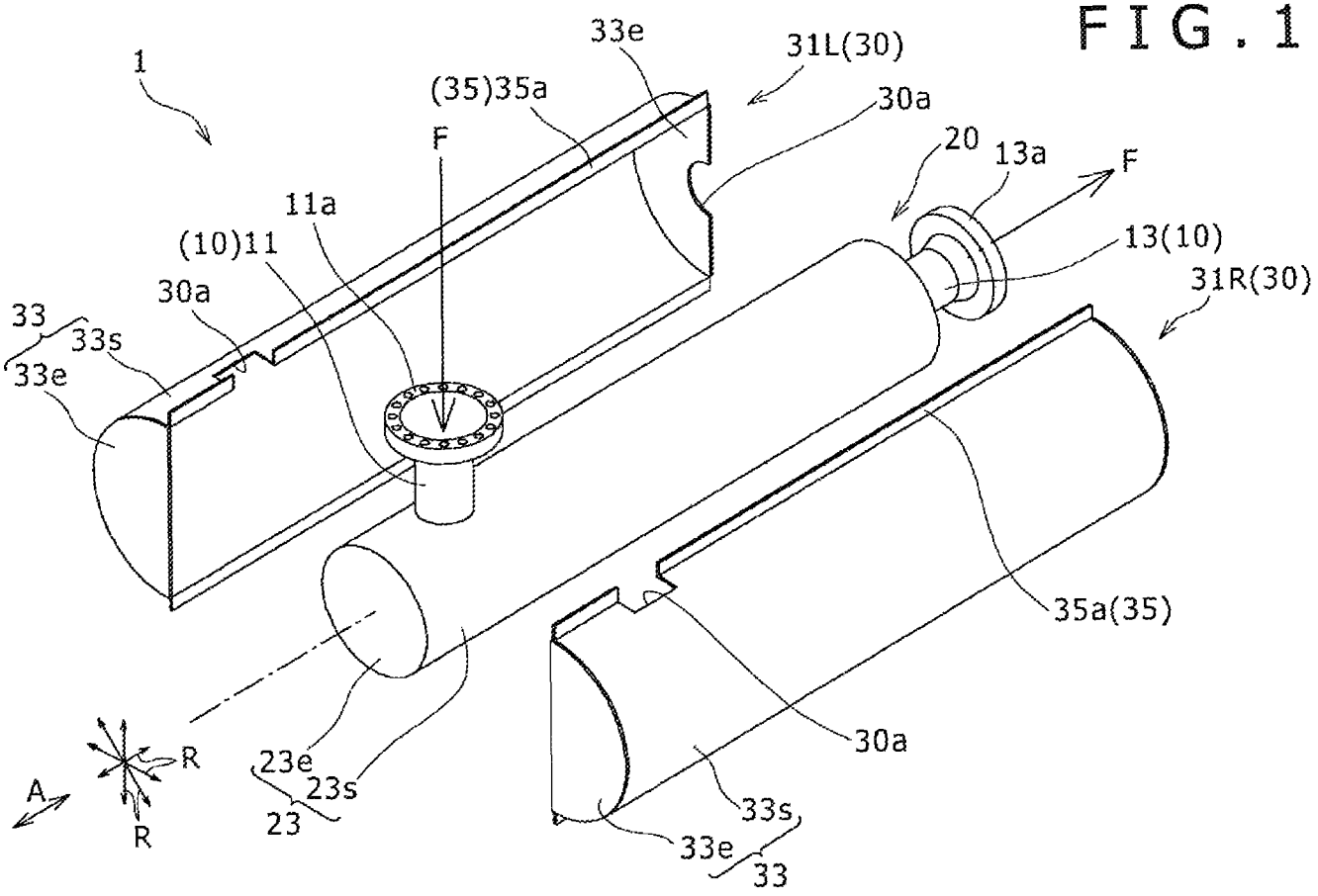
FIG. 1 is a perspective view of a muffler sound-insulation structure of a first embodiment, showing a state with a soundproof cover (30) disassembled.

The muffler sound-insulation structure 1 is a structure for insulating a noise made by a fluid F, as shown in FIG. 1. The fluid F is, for example, the air. The muffler sound-insulation structure 1 is connected, for example, to a compressor. The compressor is, for example, a source of high pressure air in a factory or the like. The compressor is, for example, a turbo compressor (a centrifugal type compressor or an axial-flow type compressor) or, for example, a displacement compressor. The displacement compressor is, for example, a reciprocating compressor or a screw compressor (oil-cooled type or oil-free type (dry type)). The compressor intakes and exhausts (discharges) the fluid F. In this connection, hereinbelow, the upstream of the fluid F may simply be referred to as "upstream", and the downstream of the fluid F may simply be referred to as "downstream". The compressor and devices in the periphery of the compressor are sources of the noise. Specifically, the sources of the noise is a pressure pulsation of the fluid F that is generated by driving of the compressor, an air flow-sound of the fluid F (a sound generated due to a disturbance of air stream or the like), or the like. When the compressor is a centrifugal type compressor or a screw type compressor, a peak frequency of the noise is about 400 Hz, or the like.

Figure 2:
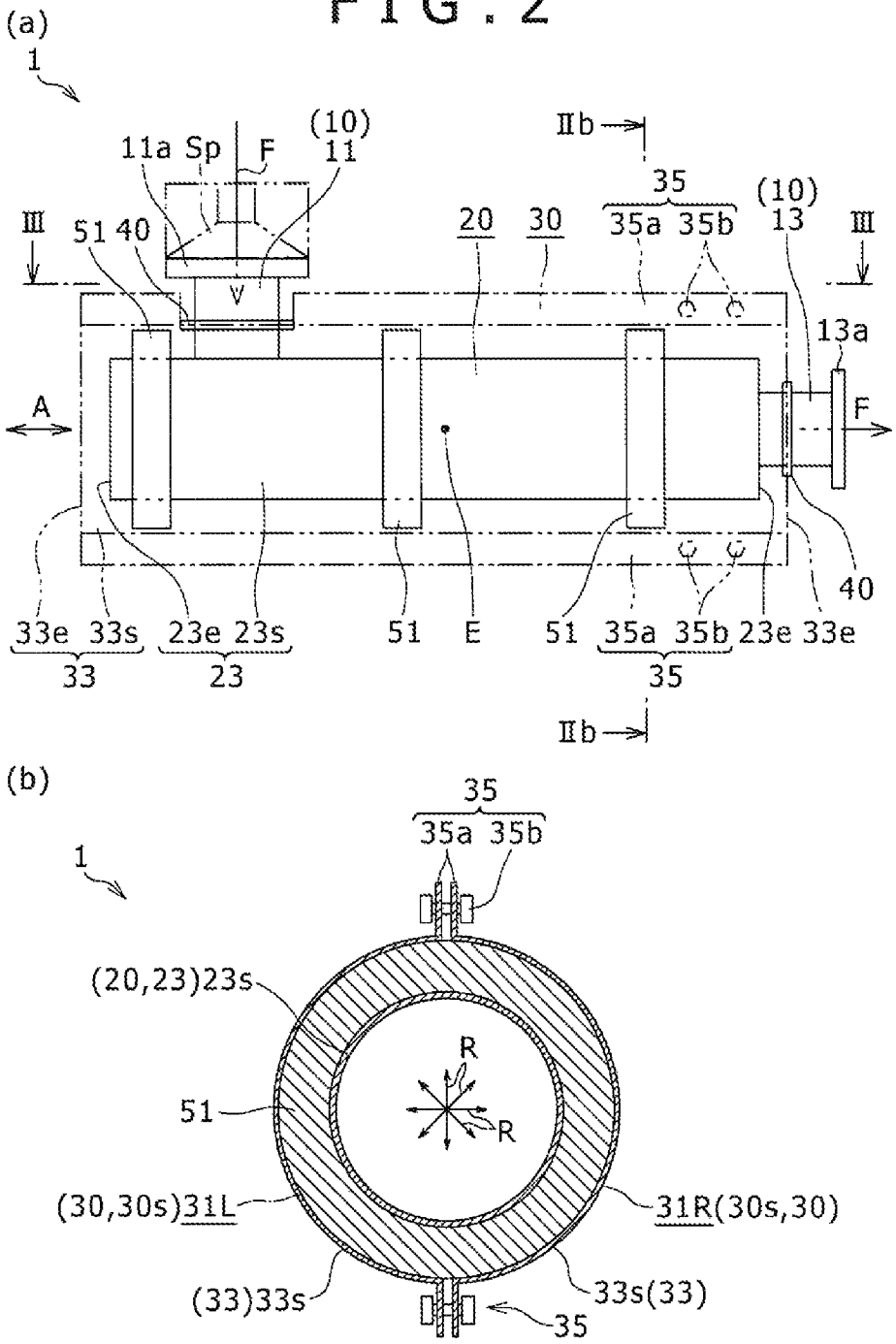
FIG. 2 (*a*) is a plan of the muffler sound-insulation structure shown in FIG. 1 viewed from the side.

The muffler sound-insulation structure 1 may be provided, for example, on a side of exhaust of the compressor (a side of exhaust having a larger noise than a side of intake), and may be provided, for example, on a side of intake of the compressor. Hereinbelow described is a case where the muffler sound-insulation structure 1 is provided on a side of exhaust of the compressor. The muffler sound-insulation structure 1 comprises a pipe 10, a muffler 20, a soundproof cover 30; and putty 40 and rock wool tapes 51 (heat insulating material) which are shown in FIG. 2 (*a*) and FIG. 3.

The pipe 10 is a pipe through which the fluid F flows inside, as shown in FIG. 1. The pipe 10 is linked to the muffler 20, and makes the inside and the outside of the muffler 20 communicate with each other. The pipe 10 comprises an upstream-side pipe 11 and a downstream-side pipe 13.

The upstream-side pipe 11 is linked to an upstream-side part (an end of the upstream-side or the vicinity of the end) of the muffler 20 (which will be described later). The upstream-side pipe 11 may be fixed, for example, to the upper end of the muffler 20, or for example, may be fixed to an end in an axial direction A (which will be described later) of the muffler 20 (not illustrated). The upstream-side pipe 11 is linked to a discharge port of the compressor. The link may be either indirect (via a pipe not illustrated) or direct. The upstream-side pipe 11 comprises an upstream-side flange 11*a*. The upstream-side flange 11*a* is a collar for a pipe link-up. The upstream-side flange 11*a* is provided in the most upstream-side part of the upstream-side pipe 11.

The downstream-side pipe 13 is linked to a downstream-side part (an end of the downstream-side or the vicinity of the end) of the muffler 20 (which will be described later). The downstream-side pipe 13 is fixed, for example, to an end in the axial direction A (which will be described later) of the muffler 20. The downstream-side pipe 13 comprises a downstream-side flange 13*a*. The downstream-side flange 13*a* is a collar for a pipe link-up. The downstream-side flange 13*a* is provided in the most downstream-side part of the downstream-side pipe 13.

The muffler 20 reduces energy of sound of the fluid F which flows inside the muffler 20. The muffler 20 reduces the energy of sound, for example, by enlarging and contracting an area of a cross section of a flow path of the fluid F (an area of a cross section orthogonal to a direction of the flow of the fluid F). The muffler 20 is linked to the compressor via the upstream-side pipe 11. As shown in FIG. 1, the muffler 20 is in a shape having the axial direction A. Specifically, the muffler 20 comprises a muffler main body 23 (which will be described later). The fluid F inside the muffler 20 flows substantially along the axial direction A. The muffler 20 may further comprise a member which is fixed to the muffler main body 23 (a rib 225, or the like (see FIG. 5 (*a*)) which will be described later).

The muffler main body 23 has a circumferential cross section when viewed from the axial direction A (see FIG. 2 (*b*). The "circumferential cross section" will be described later, in detail). Hereinbelow described is a case where the circumferential cross section of the muffler main body 23 is circumferential as shown in FIG. 2 (*b*). The muffler main body 23 has a columnar outer shape (a shape of a cylinder having the both ends in the axial direction closed). The radial direction of a circle of a circumferential cross section of the muffler main body 23 is referred to as "radial direction R". A diameter of a circumferential cross section of the muffler main body 23 is 800 mm or more, or the like. The muffler main body 23 shown in FIG. 2 (*a*) (muffler 20) may be, for example, a horizontal type (the axial direction A is in parallel with the horizontal direction), or for example, a vertical type (the axial direction A is in the vertical direction) (not illustrated), wherein the axial direction A may be inclined relative to the horizontal direction or the vertical direction (not illustrated). As shown in FIG. 1, the muffler main body 23 comprises end faces 23*e*, and a side face 23*s*.

The end faces 23*e* are faces of the both end parts in the axial direction A (two faces), among the surfaces which constitute the muffler main body 23, as shown in FIG. 2 (*a*). As shown in FIG. 1, the end faces 23*e* have a circular (or substantially circular) shape.

The side face 23*s* is the portion having a circumferential (circular, see FIG. 2 (*b*)) cross section viewed from the axial direction A, among the surfaces which constitute the muffler main body 23. As shown in FIG. 2 (*a*), the side face 23*s* is a face orthogonal to the radial direction R, which connects the two end faces 23*e* to each other.

The soundproof cover 30 reduces (insulates) a noise emitted from the surface of the muffler 20. As shown in FIG. 1, the soundproof cover 30 encloses (accommodates) the muffler 20. The soundproof cover 30 encloses the surface (the outer shell) of the muffler 20, so as to be along the surface of the muffler 20. The soundproof cover 30 covers the outer side in the radial direction R (the outer side of the side face 23*s*) and the outer sides in the axial direction A (the outer sides of the end faces 23*e*) of the muffler 20. Incidentally, in FIG. 2 (*a*), the soundproof cover 30 is shown by an imaginary line.

Figure 3:
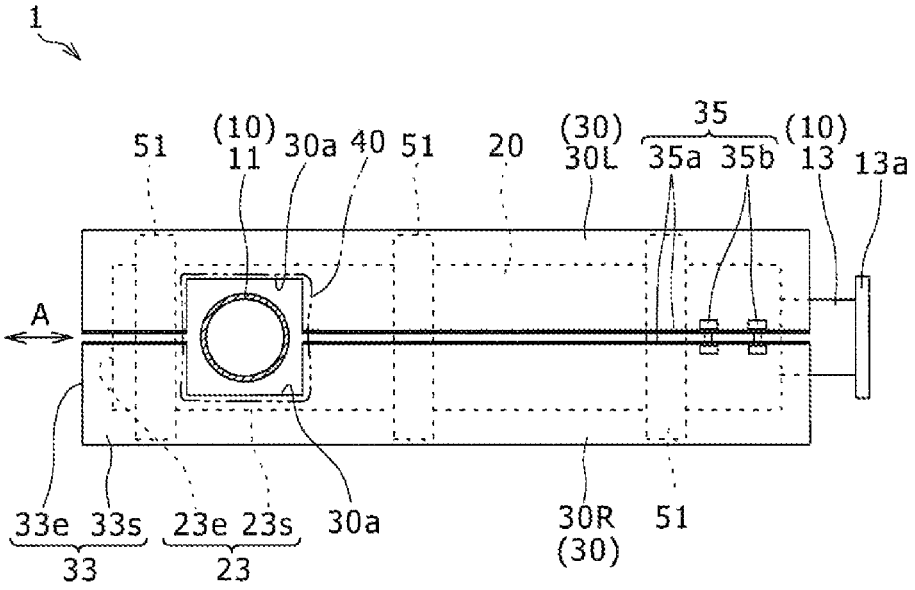
FIG. 3 is a cross-sectional view taken along an arrow III in FIG. 2 (*a*).

The soundproof cover 30 is disposed such that a vibration of the muffler 20 is not propagated directly to the soundproof cover 30. Specifically, as shown in FIG. 2 (*b*), the soundproof cover 30 is in non-contact with the muffler 20. The soundproof cover 30 is not in direct contact with the muffler 20, neither, for example, being fixed to the muffler 20 nor, for example, being welded to the muffler 20. The soundproof cover 30 is set in a floating manner relative to the muffler 20, and is vibration-isolated from the muffler 20. The above "non-contact" includes such cases where the soundproof cover 30 is in contact with the muffler 20 via another member (such as a rock wool tape 51 which will be described later). As shown in FIG. 1, on the soundproof cover 30, notches 30*a* for passing through the pipe 10 are formed. Shape of the notch 30*a* is rectangle, circle, etc. As shown in FIG. 3, the soundproof cover 30 is disposed with a gap (a gap in which a putty 40 which will be described later is disposed) between itself and the pipe 10.

The soundproof cover 30 is configured so as to be capable of sufficiently insulating a noise of the muffler 20 (so as to be capable of sufficiently ensuring the sound insulation performance). The sound insulation performance (sound-insulation amount) increases in proportion to weight of an insulation object (mass law). The thickness of the soundproof cover 30 in the cross section shown in FIG. 2 (*b*) (the thickness in the radial direction R) is, for example, about 5 mm or more. The soundproof cover 30 is constituted, for example, of an iron plate (including a steel plate). In a case where the soundproof cover 30 consists of iron plate having a thickness of 5 mm, the sound insulation amount of the soundproof cover 30 is 35 dB at 500 Hz according to the mass law. In this case, it is possible to sufficiently ensure the sound insulation performance.

The soundproof cover 30 has an axial direction. A cover main body 33 (which will be described later) of the soundproof cover 30 is configured so as to comprise a circumferential cross sections 30*s* when viewed from the axial direction A (FIG. 2 (*a*)). The above "circumferential" may refer to, for example, a circular shape, for example, any oval circumferential shape (not illustrated), for example, a shape of periphery of any polygonal shape (not illustrated), or for example, a shape of periphery consisting of a combination of an arc and a straight line (the same is true for the "circumferential cross section" of the muffler main body 23). Hereinbelow described is a case where the circumferential cross section 30*s* of the soundproof cover 30 has a circular shape. The soundproof cover 30 is disposed so as to be concentric with the muffler 20. The axial direction and the radial direction of the soundproof cover 30 coincide with the axial direction A and the radial direction R of the muffler 20. As shown in FIG. 1, the soundproof cover 30 has a cylindrical outer shape while the inside is hollow (a shape of a cylinder having the both ends in the axial direction closed), or the like.

The soundproof cover 30 is attachable/detachable relative to the muffler 20 (which will be described later). The soundproof cover 30 is configured so as to be disassemblable and comprises plural unit soundproof covers 31R, 31L. The soundproof cover 30 also comprises a cover main body 33 and connecting parts 35.

The unit soundproof covers 31R, 31L each constitute portions of the circumferential cross section 30*s* of the soundproof cover 30, as shown in FIG. 2 (*b*). Number of the unit soundproof covers 31R, 31L is plural. For example, it may be 2 (the soundproof cover 30 has a two parts structure) or for example, it may be 3 or more (not illustrated). As shown in FIG. 1, the plural unit soundproof covers 31R, 31L are each configured to be "attachable and detachable" relative to the muffler 20 by being moved in a "direction orthogonal to the axial direction A" of the muffler 20. The above "direction orthogonal to the axial direction A" is the radial direction R, for example in lateral direction (orthogonally to the axial direction A and in parallel to the horizontal direction at the same time), or for example, in an up-down direction (not illustrated), or the like. The two unit soundproof covers 31R, 31L sandwich the side face 23*s* of the muffler 20 laterally from outside (from both sides). The above "attachable and detachable" unit soundproof covers 31R, 31L specifically have cross sections in semicircular shape or the like, when viewed from the axial direction A, as shown in FIG. 2 (*b*). Incidentally, unit soundproof covers 31R, 31L which are not "attachable and detachable" as the above include, for example, those having the cross section in a C-shape (a shape having a longer arc than that of a semicircle). Each of the unit soundproof covers 31R, 31L comprises a portion of the cover main body 33 and a portion of the connecting parts 35. Hereinbelow described is the unit soundproof cover 31R and the unit soundproof cover 31L in an assembled state.

In the soundproof cover 30, the cover main body 33 is a portion having a columnar outer shape as shown in FIG. 1. The cover main body 33 comprises end faces 33*e* and a side face 33*s*. The end faces 33*e* of the cover body 33 are the both ends of the cover main body 33 in the axial direction A (two sides). The end faces 33*e* have a circular shape (or a substantially circular shape). In the surfaces which constitute the cover main body 33, the side face 33*s* is the portion having a circumferential (circular) cross section when viewed from the axial direction A (see FIG. 2 (*b*)). The side face 33*s* is a face orthogonal to the radial direction R, which connects the end faces 33*e* with each other.

The connecting parts 35 connect the plural unit soundproof covers 31R, 31L with one another in an attachable/detachable manner. As shown in FIG. 2 (*b*), the connecting parts 35 are provided on the circumference of the circumferential cross section 30*s* ("on the circumference" includes "on the substantial circumference" here and hereinbelow). The connecting parts 35 may be disposed, for example, on the upper end part and the lower end part of the circumferential cross-section 30*s*, or for example, on the left end part and the right end part of the circumferential cross section 30*s* (the both ends in the lateral direction) (not illustrated). The connecting parts 35 are disposed on the both end parts of each of the unit soundproof covers 31R, 31L (specifically, on the both end parts of the arc of the semicircular cross section). As shown in FIG. 1, the connecting parts 35 are provided along a straight line which is parallel to the axial direction A, and are provided along the longitudinal direction of the soundproof cover 30. As shown in FIG. 2 (*a*), the connecting parts 35 comprise projecting parts 35*a*, and fastening members 35*b*.

The projecting parts 35*a* are parts which are fastened by the fastening members 35*b*. As shown in FIG. 1, the projecting parts 35*a* are plates (projecting plates, end part panels, or rib-like members). The projecting parts 35*a* are fixed to the cover main body 33. The projecting parts 35*a* project outward in the radial direction R from the cover main body 33 (outward in a direction orthogonal to the circumferential direction of the circumferential cross section 30*s* as shown in FIG. 2 (*b*)). As shown in FIG. 2 (*b*), the projecting parts 35*a* of the separate unit soundproof covers 31R, 31L are disposed in parallel and adjacent to each other. The above "adjacent to" includes cases of contacting with each other and cases of having a gap between each other. These projecting parts 35*a* may be referred to as surfaces facing each other. Each of the projecting parts 35*a* has an aperture formed thereon, which passes through the fastening member 35*b* (not illustrated).

The fastening members 35*b* fasten (bond) the projecting parts 35*a* of the separate unit soundproof covers 31R, 31L to each other. Concretely, the fastening members 35*b* are bolts and nuts. The fastening members 35*b* are provided in plural numbers. FIG. 2 (*a*) illustrates only a part (only four) of the plural fastening members 35*b*.

The putty 40 (putty material) fills the gap between the pipe 10 and the soundproof cover 30 (seals the gap, or fills up the gap). The putty 40 fills the gap(s) between the upstream-side pipe 11 and/or the downstream-side pipe 13 and the notch(es) 30*a* of the soundproof cover 30. The putty 40 is a heat-resistant putty durable in the surface temperature of the pipe 10 (which may become, for example, 200° C. to 300° C.). The putty 40 has a flexibility capable of suppressing a propagation of a vibration from the pipe 10 to the soundproof cover 30. In FIG. 3, the putty 40 provided on the upstream-side pipe 11 is shown by an imaginary line, and illustration of the putty 40 provided on the downstream-side pipe 13 is omitted.

The rock wool tapes 51 (porous material) are provided between the muffler 20 and the soundproof cover 30, as shown in FIG. 2 (B). The rock wool tapes 51 support (fix) the soundproof cover 30 onto the muffler 20. The rock wool tapes 51 contact the outer surface of the muffler 20 and contact the inner surface of the soundproof cover 30. As shown in FIG. 2 (*a*), the rock wool tapes 51 have a tape-like shape (strip-like shape). The rock wool tapes 51 are provided in the axial direction A in plural numbers with spaces (the spaces may be omitted). The rockwool tapes 51 are wound along the outer periphery (circumference) of the side face 23*s* of the muffler 20, for example, over the entire periphery. The rock wool tapes 51 are wound around the muffler 20 several rounds (such as two to three rounds). A thickness of the rock wool tapes 51 (a thickness per one round) is, for example, about 0.5 mm, or the like. Incidentally, the rock wool tapes 51 may be removed from the muffler 20 at a time of overhaul of the muffler sound-insulation structure 1, and may be rewound around the muffler 20 at a time of assembly.

The rock wool tapes 51 are a porous material. The porous material is capable of suppressing a propagation of a vibration. Concretely, the rock wool tapes 51 are capable of suppressing a propagation of a vibration from the muffler 20 to the soundproof cover 30. The porous material has a sound absorbency. Concretely, the rock wool tapes 51 are capable of reducing a reflected sound between the outer surface of the muffler 20 and the inner surface of the soundproof cover 30. More particularly, as an air which conveys the reflected sound passes through the porous material, a friction is generated between the air and the porous material, and this friction dissipates energy of the sound. As a result, a noise from the inside of the soundproof cover 30, which leaks through the gap of the soundproof cover 30 to the outside of the soundproof cover 30 is suppressed. The above "gap of the soundproof cover 30", concretely, is the gap between the two projecting parts 35*a* of the connecting parts 35.

The rock wool tapes 51 are a porous heat insulating material, and suppress a heat transfer from the muffler 20 to the soundproof cover 30. The rock wool tapes 51 comprise porous fibers. Incidentally, the rock wool tapes 51 may be substituted with another porous material (for example, other porous fibers, for example, a glass wool, or the like).

(Measurement of Sound Insulation Property of Soundproof Cover 30)

Sound insulation properties are compared between the muffler sound-insulation structure 1 of the present embodiment shown in FIG. 2 (*a*) and a muffler silencing structure of the Comparative example. The comparative example is the same muffler sound-insulation structure 1 except that the soundproof cover 30 and the rock wool tapes 51 removed. The measurement was conducted as in the following (a) to (c). (a) A speaker Sp was installed on the upstream-side flange 11*a*. (b) A white noise was generated by the speaker Sp. (c) Relationship between frequency and vibration velocity level was researched on each of the muffler sound-insulation structure 1 of the present embodiment and the Comparative example. Measurement positions of the vibration velocity levels are as follows. Measurement position in the muffler sound-insulation structure 1 is a vibration evaluation point E on the surface of the side face 33*s* of the soundproof cover 30. Measurement position in the Comparative example is a position corresponding to the vibration evaluation point E on the surface of the side face 23*s* of the muffler 20 (a position corresponding to the vibration evaluation point E when viewed from the side).

Figure 4:
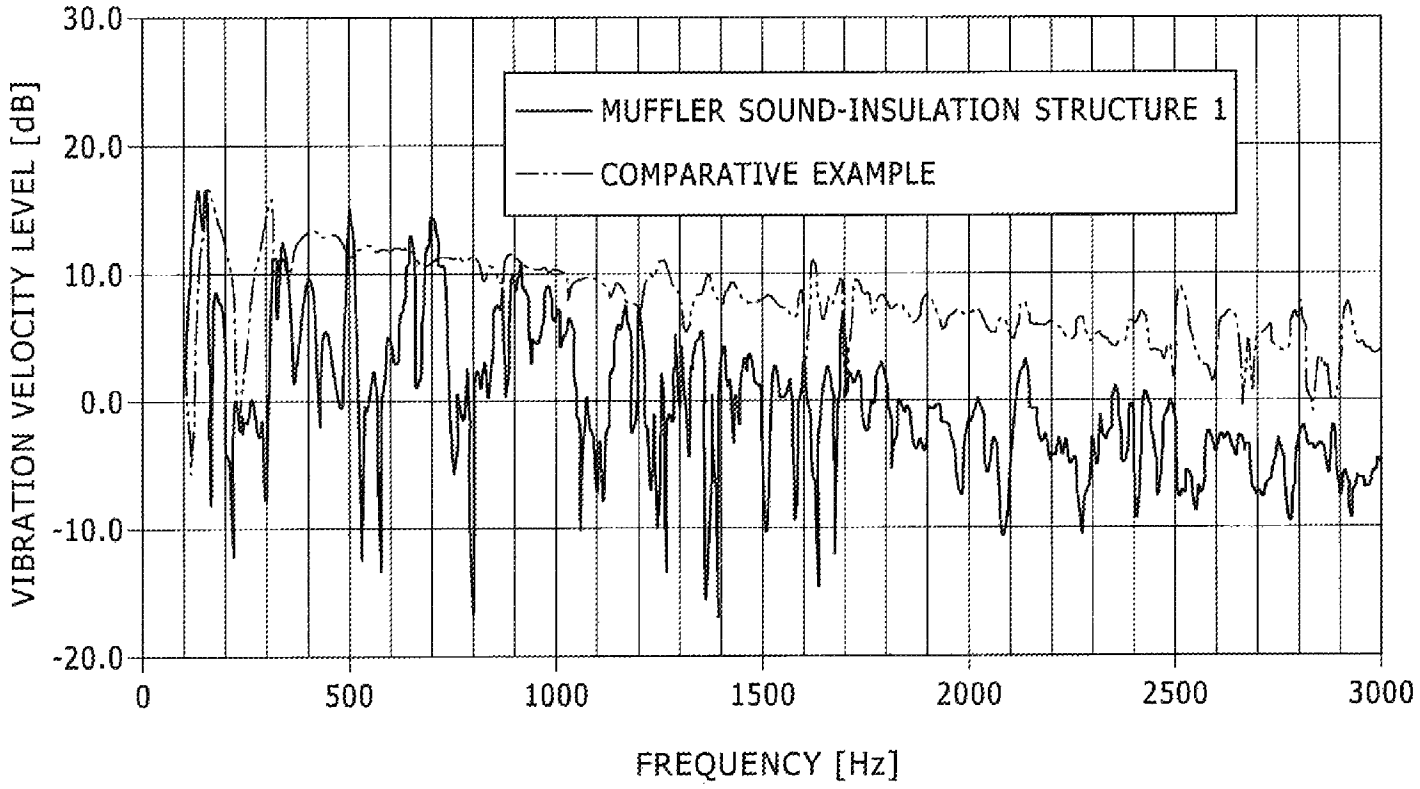
FIG. 4 is a graph showing a relationship between frequency and vibration velocity level in the muffler sound-insulation structure shown in FIG. 1.

Results of the measurement are shown in FIG. 4. Vibration velocity levels on the surface of the soundproof cover 30 of the muffler sound-insulation structure 1 were lowered by approximately 5 dB-10 dB compared to the vibration velocity levels on the surface of the muffler 20 of the Comparative example, in the frequency band of 800 Hz or higher.

(Effect 1)

In the next place, effects of the muffler sound-insulation structure 1 shown in FIG. 1 will be described. The muffler sound-insulation structure 1 has the axial direction A and comprises the muffler 20 through which the fluid F flows inside, and the soundproof cover 30. The soundproof cover 30 comprises the unit soundproof covers 31R, 31L and the connecting parts 35.

[Structure 1-1]

The soundproof cover 30 encloses the muffler 20 in a state of non-contact to the muffler 20.

[Structure 1-2]

The soundproof cover 30 is formed so as to have the circumferential cross section 30*s* when viewed from the axial direction A (see FIG. 2 (*b*)), and configured to be disassemblable.

[Structure 1-3]

As shown in FIG. 2 (*b*), the plural unit soundproof covers 31R, 31L each constitute portions of the circumferential cross section 30*s*.

[Structure 1-4]

The connecting parts 35 are provided on the circumference of the circumferential cross section 30*s*, and connect the plural unit soundproof covers 31R, 31L with one another in an attachable/detachable manner.

[Structure 1-5]

As shown in FIG. 1, each of the plural unit soundproof covers 31R, 31L is configured to be "attachable and detachable" relative to the muffler 20 by being moved in a direction orthogonal to the axial direction A (the radial direction R) of the muffler 20.

The muffler sound-insulation structure 1 comprises the above [structure 1-1]. Therefore, a vibration is not directly propagated from the muffler 20 to the soundproof cover 30. Thus, it is possible to inhibit the soundproof cover 30 from violating, and accordingly, it is possible to inhibit the surface of the soundproof cover 30 from becoming a source of noise (an emission face of sound). As a result, it is possible to ensure the sound-insulation property of the muffler sound-insulation structure 1.

The muffler sound-insulation structure 1 comprises the above [structure 1-2] and the [structure 1-3]. Accordingly, it is possible to actualize the structure in which the soundproof cover 30 is disassemblable and encloses the muffler 20. Since the soundproof cover 30 encloses the muffler 20, it is possible to insulate a noise emitted from the muffler 20, and as a result, it is possible to ensure the sound-insulation property of the muffler sound-insulation structure 1.

In the muffler sound-insulation structure 1, the soundproof cover 30 is disassemblable (see the [structure 1-2]) and comprises the above [structure 1-4] and [structure 1-5]. Therefore, by fixing/unfixing the connecting parts 35, each of the plural unit soundproof covers 31R, 31L is easily attachable and detachable relative to the muffler 20. Thus, it is possible to ensure the ease of maintenance of the muffler sound-insulation structure 1.

(Effect 2)

As shown in FIG. 2 (*a*), the muffler sound-insulation structure 1 comprises the putty 40 and the pipe 10 that is linked to the muffler 20, through which the fluid F flows inside.

[Structure 2]

The putty 40 fills the gap between the pipe 10 and the soundproof cover 30.

With the above [structure 2], it is possible to insulate a sound leaked from the gap between the pipe 10 and the soundproof cover 30 to the outside of the soundproof cover 30. Thus, it is possible to improve the sound-insulation property of the muffler sound-insulation structure 1. The member which fills the gap between the pipe 10 and the soundproof cover 30 is the putty 40 (the [structure 2] above). Therefore, it is possible to suppress a vibration which is propagated from the pipe 10 to the soundproof cover 30 better than in a case where the gap is filled with a material which easily propagates the vibration compared to the putty 40 (a metal, etc.). Thus, it is possible to improve the sound-insulation property of the muffler sound-insulation structure 1.

(Effect 3)

As shown in FIG. 2 (*b*), the muffler sound-insulation structure 1 comprises the rock wool tapes 51 (porous material) provided between the muffler 20 and the soundproof cover 30.

In this structure, a reflected sound between the muffler 20 and the soundproof cover 30 is reduced by the rock wool tapes 51 which are a porous material. Therefore, it is possible to inhibit the vibration of the reflected sound from being propagated to the soundproof cover 30. It is also possible to inhibit the reflected sound from leaking from the gap of the soundproof cover 30 (the gap of the connecting parts 35, specifically, the gap between the projecting parts 35*a*). Thus, it is possible to improve the sound-insulation property of the muffler sound-insulation structure 1.

In a case where the rock wool tapes 51 are contacted with the muffler 20 and the soundproof cover 30, the vibration which is propagated from the muffler 20 to the soundproof cover 30 is suppressed by the rock wool tapes 51 (the rock wool tapes 51 function as vibration damping material). Accordingly, the soundproof cover 30 is inhibited from vibrating. Thus, it is possible to improve the sound-insulation property of the muffler sound-insulation structure 1.

Second Embodiment

A muffler sound-insulation structure 201 of a second embodiment will be described with reference to FIG. 5 (*a*) and FIG. 5 (*b*), in respect of a difference thereof from the muffler sound-insulation structure 1 of the first embodiment (see FIG. 2 (*a*) and FIG. 2 (*b*)). The difference is a point that the muffler 20 comprises ribs 225.

Figure 5:
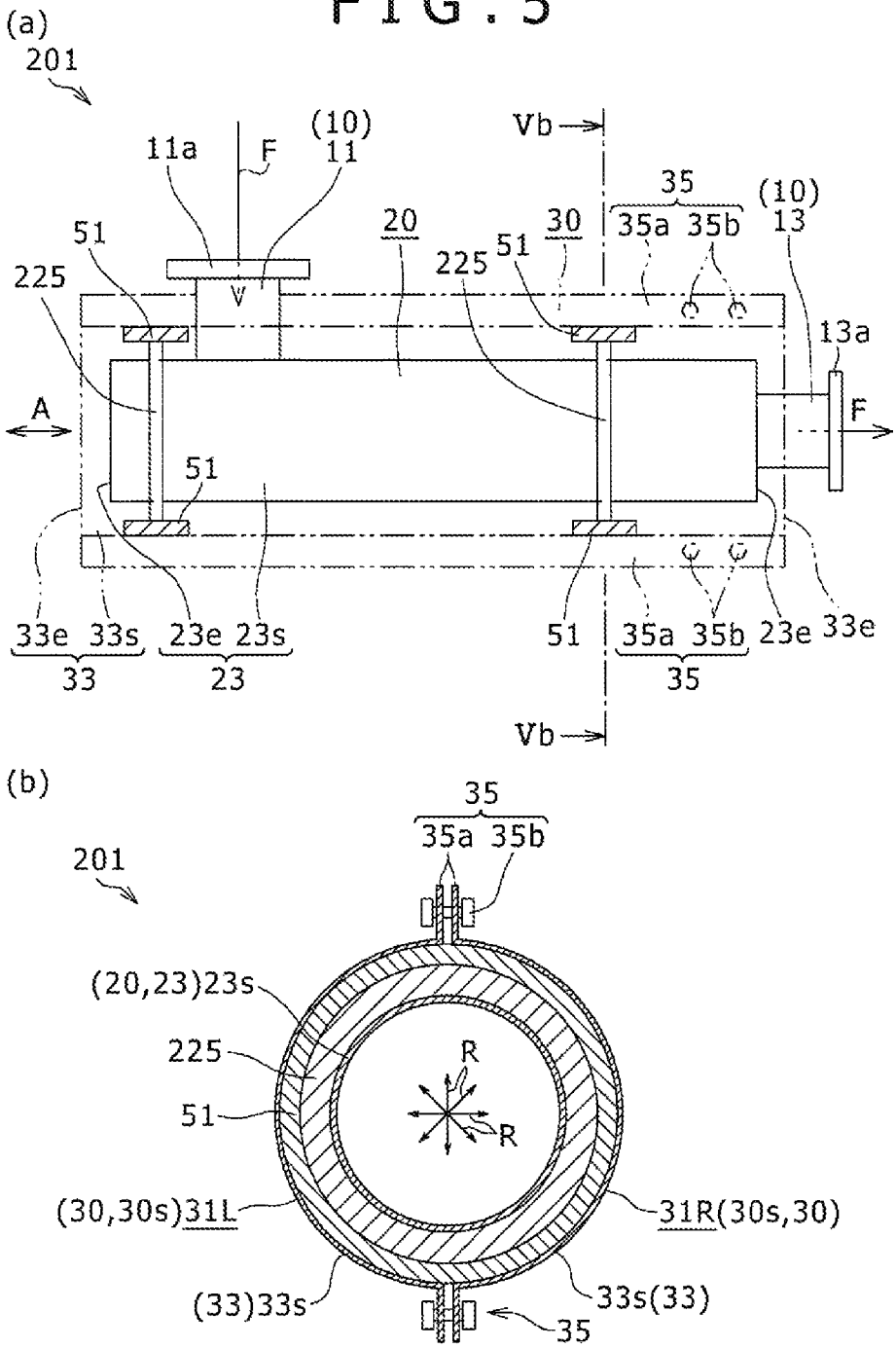
FIG. 5 (*a*) is a view of a second embodiment corresponding to FIG. 2 (*a*).

The ribs 225 support the soundproof cover 30 via the rock wool tapes 51, as shown in FIG. 5 (*a*). The ribs 225 have a plate-like shape. The ribs 225 are fixed onto the side face 23*s* of the muffler main body 23. The fixation is achieved, for example, by a welding, or the like. The ribs 225 protrude outward in the radial direction R from the side face 23*s* (outward in the direction orthogonal to the axial direction A). The ribs 225 may extend, for example, in a up-down direction when viewed from the side, or may extend, for example, in parallel with the axial direction A (not illustrated). As shown in FIG. 5 (*b*), each rock wool tape 51 is wound on each outer end part of the rib 225 in the radial direction R (the outer end part in the direction orthogonal to the axial direction A). Thickness of the rock wool tapes 51 (width in the radial direction R) is, for example, about 2 mm, or the like. The ribs 225 are closed in by the plural unit soundproof covers 31R, 31L. In this connection, in FIG. 5 (*a*), the portions of the ribs 225 are illustrated as the cross sections thereof (these cross sections are those orthogonal to the horizontal direction, which pass through the center axis of the muffler 20).

(Effects by Rib 225)

As shown in FIG. 5 (*a*), the muffler 20 comprises the ribs 225 protruding outward in the direction orthogonal to the axial direction A (outward in the radial direction R). The ribs 225 support the soundproof cover 30 via the rock wool tapes 51.

According to this structure, even in a case where the weight of the soundproof cover 30 is increased due to an increase of plate thickness (the width in the radial direction R) of the soundproof cover 30, or the like, the soundproof cover 30 is easily supported onto the muffler main body 23.

Third Embodiment

A muffler sound-insulation structure 301 of a third embodiment will be described with reference to FIG. 6 (*a*) and FIG. 6 (*b*), in respect of differences thereof from the muffler sound-insulation structure 1 of the first embodiment (see FIG. 2 (*a*) and FIG. 2 (*b*)). The differences are a point that the soundproof cover 330 has a double structure, and a glass wool 361 provided to a space inside-covers S330 (see FIG. 6 (*b*)).

Figure 6:
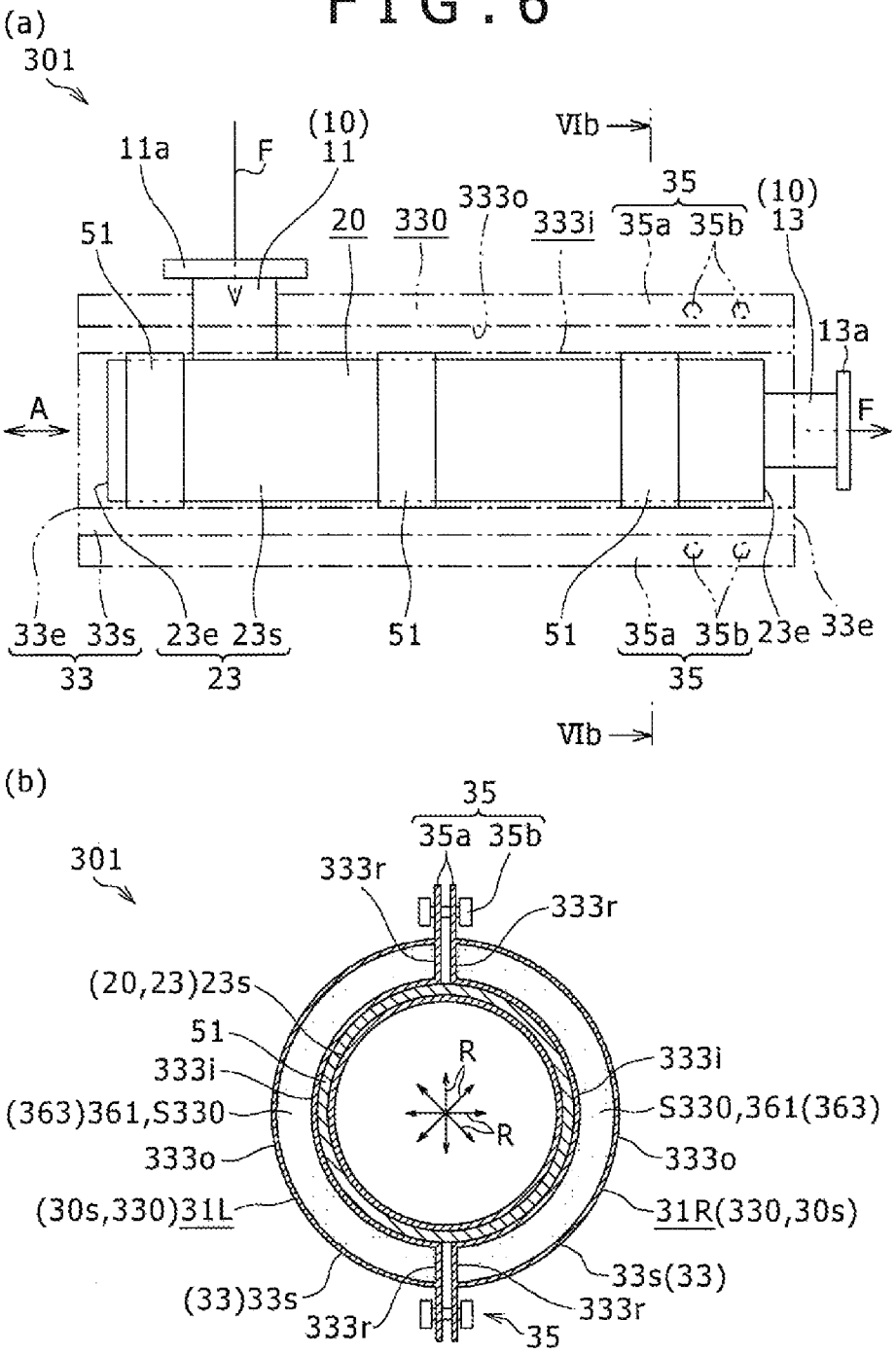
FIG. 6 (*a*) is a view of a third embodiment corresponding to FIG. 2 (*a*).

The soundproof cover 330 has a double structure of an inner wall 333*i* and an outer wall 333*o* which will be described later, as shown in FIG. 6 (*b*). As shown in FIG. 6 (*a*), the soundproof cover 330 has the double structure throughout the entire (or substantially the entire) side face 33*s*. The soundproof cover 330 may not comprise or may comprise the double structure on the end faces 33*e* (not illustrated). The soundproof cover 330 may have a triple or more structure (a wall further outer from the outer wall 333*o*). As shown in FIG. 6 (*b*), the soundproof cover 330 (each of the plural unit soundproof covers 31R, 31L) comprises the inner wall 333*i*, the outer wall 333*o*, and connecting walls 333*r*.

Each of the inner wall 333*i* and the outer wall 333*o* has a circumferential cross section similar to the circumferential cross section 30*s* (see FIG. 2(*b*)). The outer wall 333*o* is provided in a side more distant to the muffler 20 than the inner wall 333*i* is (outer side in the radial direction R).

The connecting walls 333*r* connect the inner wall 333*i* and the outer wall 333*o*. The connecting walls 333*r* are provided so as to form the spaces inside-covers S330 which will be described in the followings. The connecting walls 333*r* connect the inner wall 333*i* and the outer wall 333*o* at the parts connecting the unit soundproof covers 31R and 31L with one another (in the vicinity of the connecting parts 35, specifically, inner side in the radial direction R of the connecting parts 35).

The spaces inside-covers S330 are formed between the inner wall 333*i* and the outer wall 333*o*. The spaces inside-covers S330 are a space surrounded by the inner wall 333*i*, the outer wall 333*o*, and the connecting walls 333*r*. The spaces inside-covers S330 are, for example, a sealed space, or for example, a substantially closed space. The spaces inside-covers S330 are formed such that a stuffing (porous material or granules) may be disposed inside.

The glass wool 361 (porous material) is provided inside the spaces inside-covers S330. The glass wool 361 is a porous material (the details described above), and a porous heat insulating material, and comprises porous fibers. The glass wool 361 reduces a reflected sound in the spaces inside-covers S330 (a reflected sound between the inner wall 333*i* and the outer wall 333*o*). The glass wool 361 is provided so as to be capable of imparting a vibration damping effect to the soundproof cover 330. Concretely, the glass wool 361 is in contact (is in close contact) with the inner wall 333*i*, the outer wall 333*o*, and the connecting walls 333*r*. The glass wool 361 may be substituted with another porous material (rock wool, or the like).

(Effect 4)

Effects by the muffler sound-insulation structure 301 shown in FIG. 6 (*b*) will be described. The soundproof cover 330 comprises the inner wall 333*i*, the outer wall 333*o* which is provided in a side more distant to the muffler 20 than the inner wall 333*i* is, the spaces inside-covers S330 formed between the inner wall 333*i* and the outer wall 333*o*, and the glass wool 361 (porous material).

[Structure 4]

The glass wool 361 is provided inside the spaces inside-covers S330.

With the above [Structure 4], it is possible to reduce the reflected sound inside the spaces inside-covers S330 by the glass wool 361. Thus, it is possible to improve the sound-insulation property of the soundproof cover 330, and accordingly, it is possible to improve the sound-insulation property of the muffler sound-insulation structure 301.

With the above [Structure 4], it is possible to leave the glass wool 361 in the spaces inside-covers S330 when the soundproof cover 330 is disassembled (when the plural unit soundproof covers 31R, 31L are disassembled). Therefore, the handling (disassembling/assembling operations, transportation, etc.) of the soundproof cover 330 or the glass wool 361 is easy. Thus, it is possible to improve the ease of maintenance of the muffler sound-insulation structure 301.

[Modification of Third Embodiment]

As described above, inside of the spaces inside-covers S330 was provided with the glass wool 361 which was a porous material. However, inside of the spaces inside-covers S330 may also be provided with granules 363 (granular material), instead of, or in addition to the glass wool 361. The granules 363 may be, for example, sands (such as river sands), or for example, lime.

(Effect 5)

[Structure 5]

The soundproof cover 330 comprises the granules 363 which are provided to the spaces inside-covers S330.

In the above [Structure 5], the weight of the soundproof cover 330 is increased, as compared with a case having no granules 363 in the spaces inside-covers S330. Therefore, the sound-insulation property of the soundproof cover 330 is improved according to the mass law referred above. In addition, the reflected sound in the spaces inside-covers S330 is reduced (sound absorbency) by the air passing through spaces between the granules 363 (for example, spaces between sand grains). The above sound-insulation property and the sound absorbency further improve the sound-insulation property in the muffler sound-insulation structure 301. It is noted that the heavier the granules 363, the more the sound-insulation property of the soundproof cover 330 is improved. The more there are spaces of the granules 363, the more the sound-insulation property in the granules 363 is improved.

In the [Structure 5] above, the granules 363 are provided inside the spaces inside-covers S330. Therefore, it is possible to leave the granules 363 in the spaces inside-covers S330 when the soundproof cover 330 is disassembled (the plural unit soundproof covers 31R, 31L are disassembled). Thus, the handling (disassembling/assembling operations, transportation, etc.) of the soundproof cover 330 or the granules 363 is easy. Thus, it is possible to further improve the ease of maintenance of the muffler sound-insulation structure 301.

Fourth Embodiment

A muffler sound-insulation structure 401 of a fourth embodiment will be described with reference to FIG. 7 (*a*) and FIG. 7 (*b*), in respect of differences thereof from the muffler sound-insulation structure 1 of the first embodiment (see FIG. 2 (*a*) and FIG. 2 (*b*)). The differences are a point that the muffler 20 comprises ribs 425, and a point that the muffler sound-insulation structure 401 comprises bags 455 and granules 457 (see FIG. 7 (*b*)).

Figure 7:
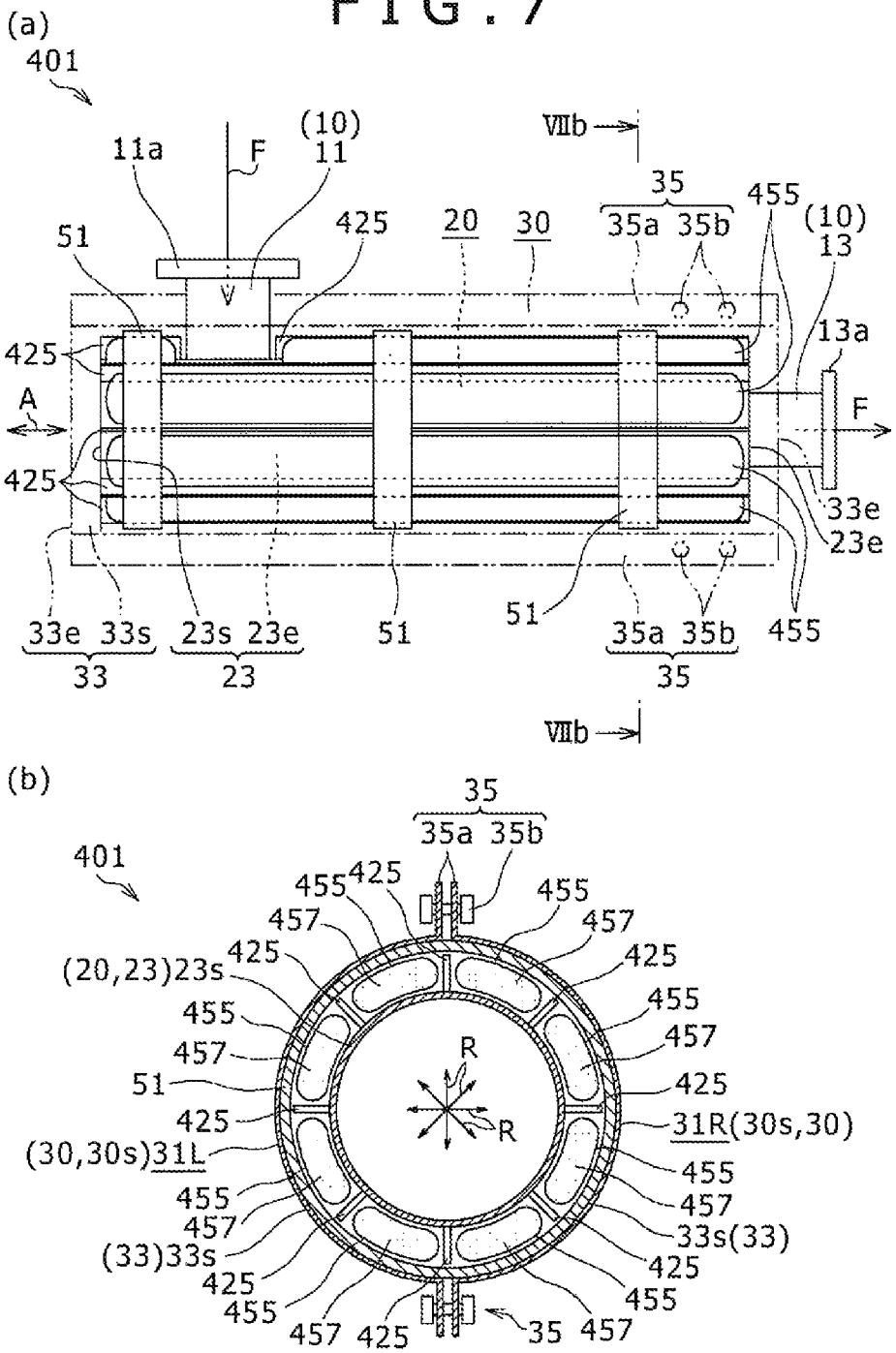
FIG. 7 (*a*) is a view of a fourth embodiment corresponding to FIG. 2 (*a*).

The ribs 425 are members which facilitate disposing the bags 455 and the granules 457 on a surface (a side face 23*s*) of the muffler main body 23, as shown in FIG. 7 (*b*). The ribs 425 have a plate-like shape. The ribs 425 protrude outward in the radial direction R from the side face 23*s* of the muffler main body 23 (outward in the direction orthogonal to the axial direction A), similarly to the ribs 225 of the second embodiment (see FIG. 5 (*a*)). As shown in FIG. 7 (*a*), the ribs 425 extend in the axial direction A. The ribs 425 may extend in a direction such as an up-down direction when viewed from the side (not illustrated). As shown in FIG. 7 (*b*), the ribs 425 are provided in plural numbers (the figure shows eight pieces). The plural ribs 425 are disposed with being spaced from each other. These spaces are, for example, spaces in a direction along the circumference of the circumferential cross section 30*s*.

The bags 455 are provided with the granules 457 inside. The bags 455 are a sand bag, when the granules 457 are sands. The bags 455 are provided between the muffler 20 (the muffler main body 23) and the soundproof cover 30. The bags 455 are provided in plural numbers. The bags 455 are provided between the ribs 425 adjacent to each other. As shown in FIG. 7 (*a*), the bags 455 are disposed along the ribs 425 (for example, in parallel with the axial direction A). The bags 455 (and the granules 457) are disposed over the entire (or substantially the entire) side face 23*s* of the muffler main body 23. The bags 455 have, for example, a columnar shape, or, when the granules 457 are not stuffed, a rectangle, or the like. As shown in FIG. 7 (*b*), the rock wool tapes 51 are wound on the outer side of the bags 455 (the outer side in the radial direction R). In this manner, the bags 455 are fixed (or substantially fixed) to the muffler 20.

The granules 457 are provided (stuffed, accommodated, or wrapped) inside the bags 455. The granules 457 are sands, or the like, similarly to the granules 363 of the third embodiment (see FIG. 6 (*b*)).

(Effect 6)

Effects of the muffler sound-insulation structure 401 shown in FIG. 7 (*b*) will be described. The muffler sound-insulation structure 401 comprises the bags 455 provided between the muffler 20 and the soundproof cover 30, and the granules 457 which are provided inside the bags 455.

In this structure, the bags 455 and the granules 457 are attachable/detachable relative to the muffler 20, in the state that the bags 455 have the granules 457 provided inside. Thus, it is possible to further improve the ease of maintenance of the muffler sound-insulation structure 401.

Fifth Embodiment

A muffler sound-insulation structure 501 of a fifth embodiment will be described with reference to FIG. 8 (*a*), FIG. 8 (*b*), and FIG. 9, in respect to differences thereof from the muffler sound-insulation structure 301 of the third embodiment (see FIG. 6 (*a*) and FIG. 6 (*b*)). The differences are a point that the spaces inside-covers S330 in the muffler sound-insulation structure 301 of the third embodiment are a sealed space (sealed spaces inside-covers S530 as shown in FIG. 8 (*b*)) in the present embodiment, and a point of comprising valves 570.

Figure 8:
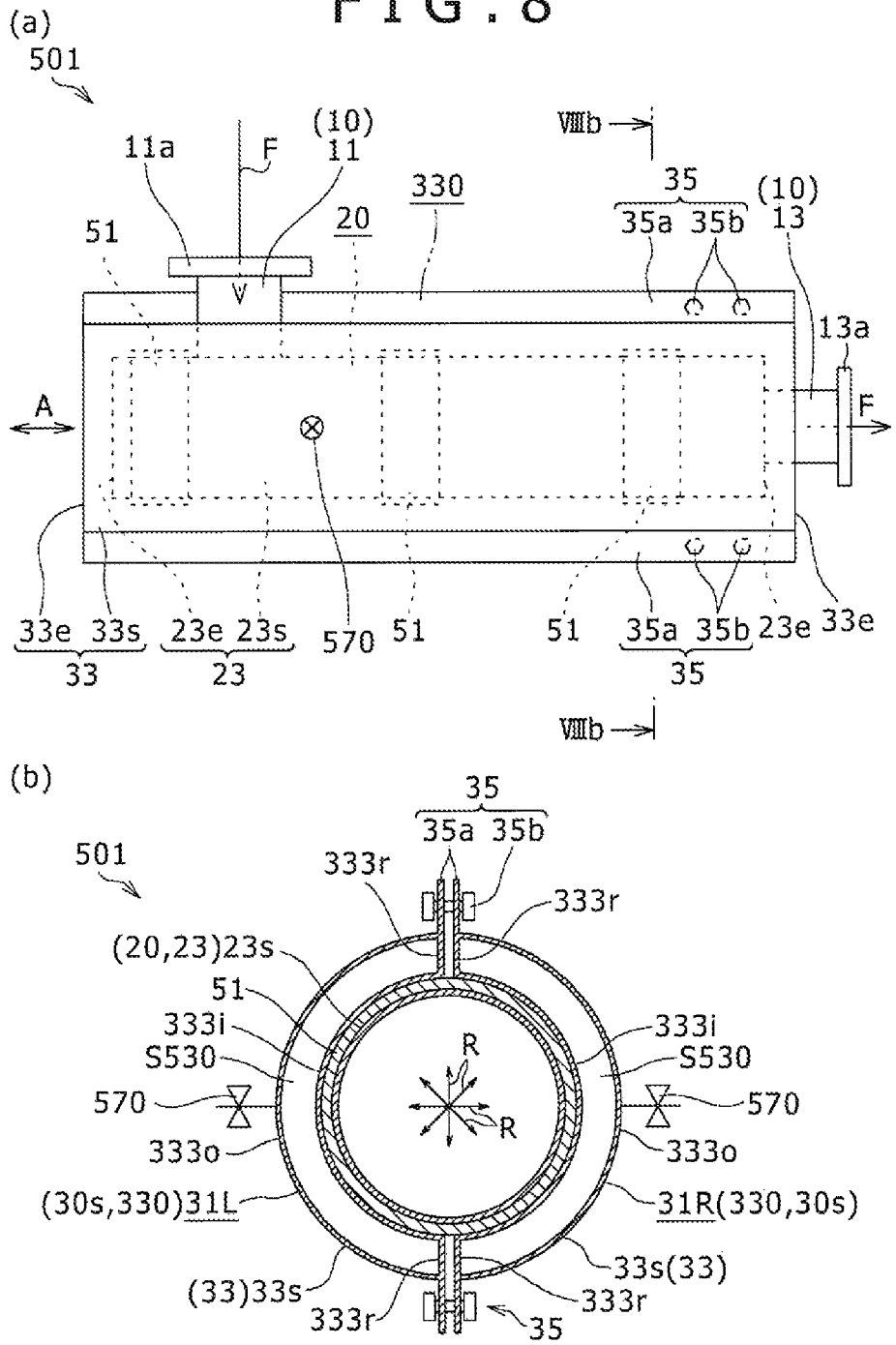
FIG. 8 (*a*) is a view of a fifth embodiment corresponding to FIG. 2 (*a*).
Figure 9:
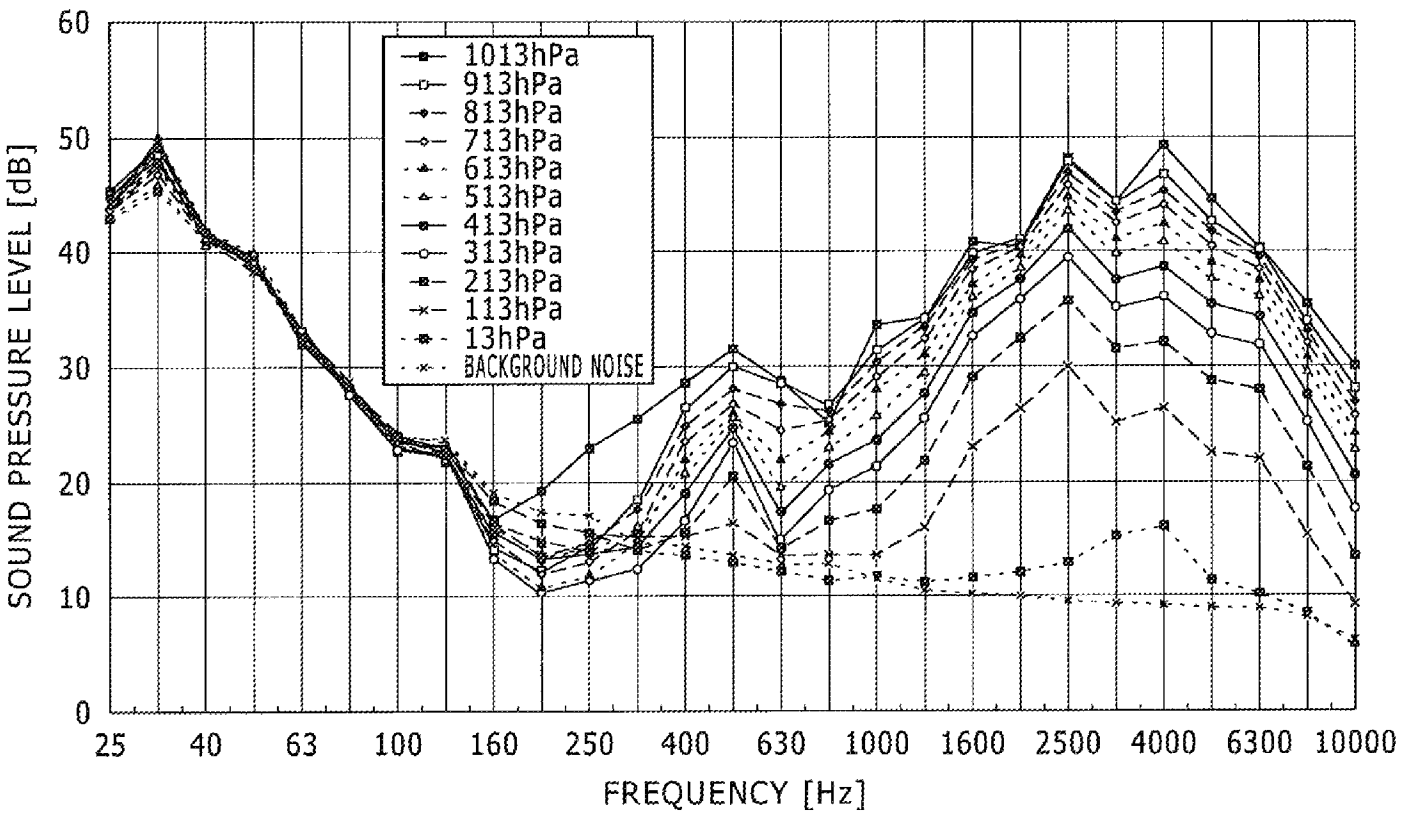
FIG. 9 is a graph showing a relationship between frequency and sound pressure level in the muffler sound-insulation structure shown in FIG. 8 (*a*).

The sealed spaces inside-covers S530 (sealed space) are provided (formed) between the outer face of the soundproof cover 330 (the outer face of the outer wall 333*o*, or the surface) and the muffler 20, as shown in FIG. 8 (*b*). The sealed spaces inside-covers S530 are a space sealed by being surrounded by the inner wall 333*i*, the outer wall 333*o*, and the connecting walls 333*r*. Pressure in the sealed spaces inside-covers S530 is depressurized relative to an air pressure outside the soundproof cover 330 (atmospheric pressure). The lower the pressure (the closer to vacuum the pressure, or, the lower the density of the air) in the sealed spaces inside-covers S530 is, the harder it becomes for a sound wave to be transmitted in the sealed spaces inside-covers S530, and as a result, the higher the sound-insulation property of the soundproof cover 330 becomes. It is preferred that the pressure in the sealed spaces inside-covers S530 is 0.05 MPa or less. The sealed spaces inside-covers S530 are provided over the entire (or substantially the entire) side face 33*s* of the soundproof cover 330, similarly to the spaces inside-covers S330 of the third embodiment (see FIG. 6 (*b*)). The sealed spaces inside-covers S530 are provided to each of the plural unit soundproof covers 31R, 31L. In the sealed spaces inside-covers S530, a core material (a material to fill up the space, not illustrated) may be disposed. The core material is, for example, a porous material or granules.

The valves 570 open and close flow paths (not illustrated) through which the inside of the sealed spaces inside-covers S530 communicates with the outside of the soundproof cover 330. The valves 570 are provided on the surface of the outer wall 333*o* (side face 33*s*). The valves 570 are opened when the inside of the sealed spaces inside-covers S530 is to be depressurized.

(Process of Depressurization)

A depressurization of the sealed spaces inside-covers S530 is carried out, for example, by the following process (a) to (d). This process allows the sealed spaces inside-covers S530 to be easily depressurized, even in a case where there is no depressurizing means (such as a vacuum pump) around a place where the muffler sound-insulation structure 501 is installed. (a) The soundproof cover 330 is disassembled into the plural unit soundproof covers 31R, 31L, and removed from the muffler 20. (b) The unit soundproof covers 31R, 31L are transported to the vicinity of a place where a depressurizing means is installed. (c) The sealed spaces inside-covers S530 of the respective unit soundproof covers 31R, 31L are depressurized by the depressurizing means. (d) The unit soundproof covers 31R, 31L are attached to the muffler 20.

(Relationship Between Pressure and Sound-Insulation Property)

The pressure in the sealed spaces inside-covers S530 was varied to research a relationship between noise level and frequency in the vicinity of the side face 33*s* of the soundproof cover 330. The results are shown in FIG. 9. When the pressure in the sealed spaces inside-covers S530 (see FIG. 8 (*b*)) was reduced to about 0.05 MPa (500 hPa) or less relative to an atmospheric pressure of 0.1 MPa (1013 hPa), a noise reduction effect of about 5 dB was obtained in the frequency range of from 1 kHz to 5 kHz.

(Effect 7-1)

Effects of the muffler sound-insulation structure 501 shown in FIG. 8 (*b*) will be described. The muffler sound-insulation structure 501 comprises the sealed spaces inside-covers S530 (sealed space) disposed between the outer face of the soundproof cover 330 (surface of the outer wall 333*o*) and the muffler 20.

[Structure 7-1]

The pressure in the sealed spaces inside-covers S530 is depressurized relative to an air pressure outside the soundproof cover 330.

According to the above [Structure 7-1], a sound wave is hard to be transmitted in the sealed spaces inside-covers S530. Thus, it is possible to improve the sound-insulation property of the muffler sound-insulation structure 501.

(Effect 8-1)

The pressure in the sealed spaces inside-covers S530 is 0.05 MPa or less. In this structure, it is possible to surely improve the sound-insulation property by the sealed spaces inside-covers S530.

Sixth Embodiment

Figure 10:
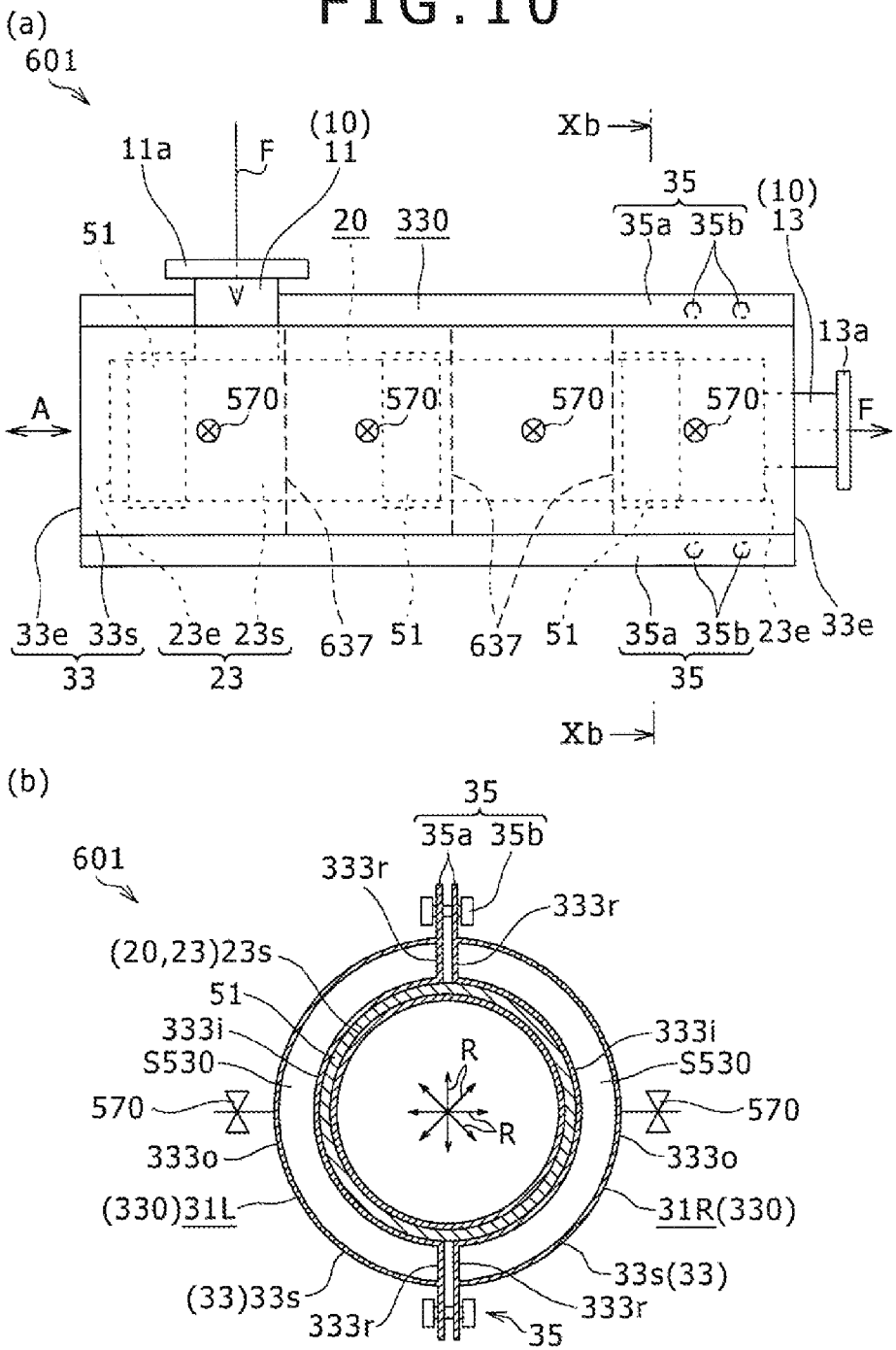
FIG. 10 (*a*) is a view of a sixth embodiment corresponding to FIG. 2 (*a*).

A muffler sound-insulation structure 601 of a sixth embodiment will be described with reference to FIG. 10 (*a*) and FIG. 10 (*b*), in respect of a difference thereof from the muffler sound-insulation structure 501 of the fifth embodiment (see FIG. 8 (*a*) and FIG. 8 (*b*)). The difference is a point that the soundproof cover 330 further comprises partition walls 637, as shown in FIG. 10 (*a*)).

The partition walls 637 partition the sealed spaces inside-covers S530. The sealed space inside-covers S530 of one unit soundproof cover 31R (or 31L) is partitioned into plural spaces with the partition walls 637, preferably into 3 or more spaces with 2 or more partition walls 637. In FIG. 10 (*a*), it is partitioned into 4 spaces with 3 partition walls 637. In FIG. 10 (*a*), the sealed spaces inside-covers S530 are partitioned into 8 spaces in total of the unit soundproof covers 31R and 31L. The partition walls 637 partition the sealed spaces inside-covers S530 such that the plural sealed space inside-covers S530 partitioned with the partition walls 637 do not communicate with each other. That is, the partition walls 637 partition the sealed spaces inside-covers S530 such that, even in a case where it becomes impossible to maintain a sealed condition in one of two sealed spaces inside-covers S530 partitioned with the partition wall 637, a sealed condition in the other space can be maintained. Each of the plural sealed spaces inside-covers S530 partitioned with the partition walls 637 is provided with the valves 570 similar to that of the fifth embodiment.

(Effect by Partition Wall 637)

Effect by the muffler sound-insulation structure 601 shown in FIG. 10 (*a*) is as follows.

If it is assumed that the sealed space inside-covers S530 of one unit soundproof cover 31R (or 31L) (see FIG. 8 (*b*)) is not partitioned with the partition wall 637 as shown in FIG. 8 (*a*), and then, that the depressurized condition in the sealed space inside-covers S530 becomes impossible to be maintained, the sound insulation performance of the entire side face 33*s* of the one unit soundproof cover 31R (see FIG. 8 (*b*)) will be deteriorated at a time.

On the other hand, in the muffler sound-insulation structure 601, the sealed spaces inside-covers S530 are partitioned with the partition walls 637 as shown in FIG. 10 (*a*). Therefore, even if a depressurized condition (for example, a vacuum condition) becomes impossible to be maintained in a part of the spaces of the sealed spaces inside-covers S530 partitioned into plural spaces with the partition walls 637, depressurized conditions in the other spaces are maintained. As a result, it is possible to inhibit the deterioration of the sound insulation performance of the entire soundproof cover 330.

Seventh Embodiment

Figure 11:
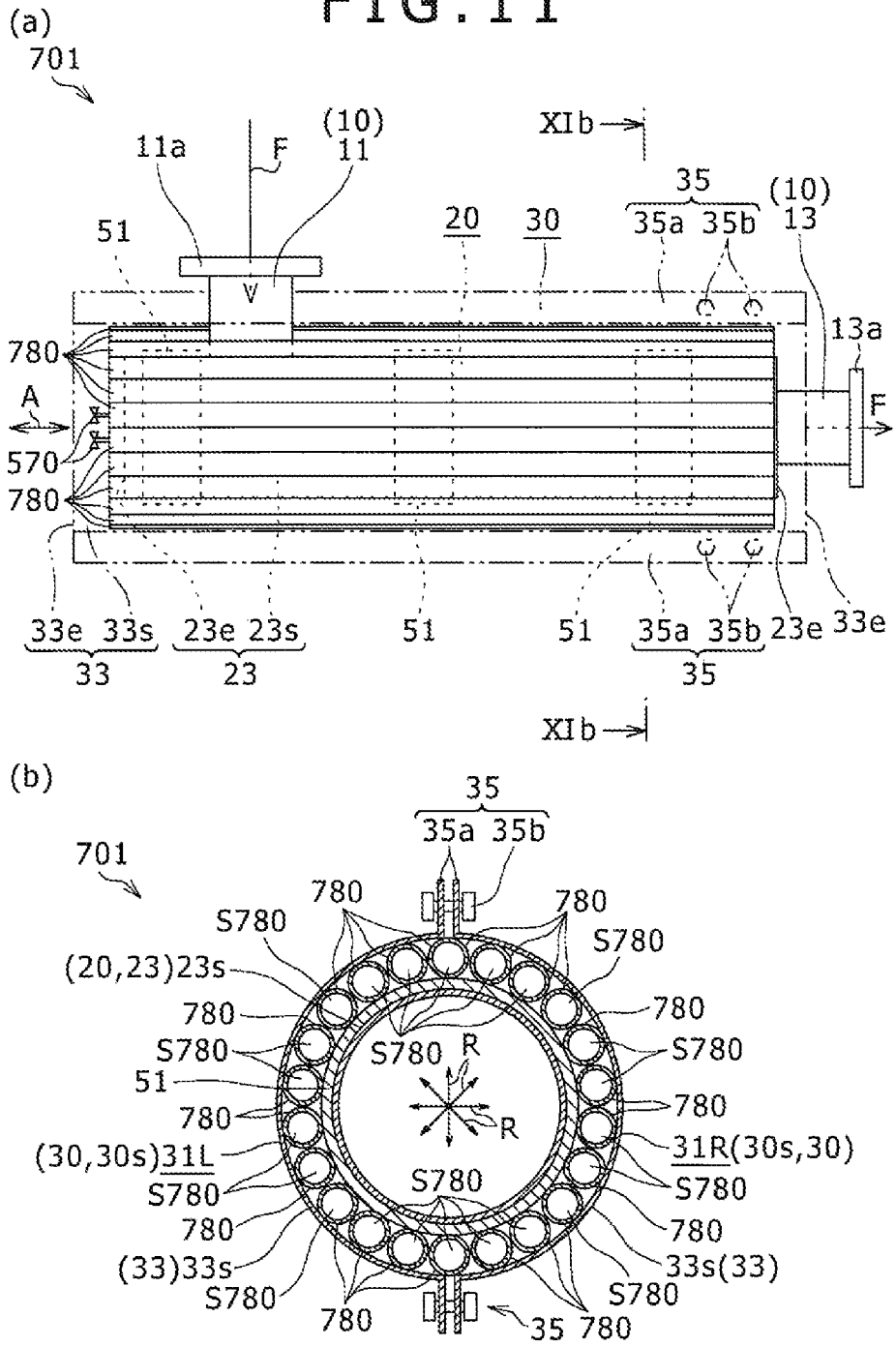
FIG. 11 (*a*) is a view of a seventh embodiment corresponding to FIG. 2 (*a*).

A muffler sound-insulation structure 701 of a seventh embodiment will be described with reference to FIG. 11 (*a*)

and FIG. 11 (*b*), in respect of a difference thereof from the muffler sound-insulation structure 1 of the first embodiment (see FIG. 2 (*a*) and FIG. 2 (*b*)). The difference is a point that the muffler sound-insulation structure 701 comprises sealed pipes 780 and sealed spaces inside-pipe S780 (sealed space) formed inside the sealed pipes 780 (see FIG. 11 (*b*)).

The sealed pipes 780 are a pipe, the inside of which are sealed, as shown in FIG. 11 (*b*). The sealed pipes 780 have a tubular shape having the both ends in the axial direction closed. In the sealed pipes 780, an inside pressure is depressurized (for example, to a vacuum state) relative to an outside pressure. The sealed pipes 780 are disposed between the side face 33*s* of the soundproof cover 30 and the sides face 23*s* of the muffler 20. The sealed pipes 780 are disposed between the rock wool tapes 51 and the soundproof cover 30. The sealed pipes 780 may also be disposed between the muffler 20 and the rock wool tapes 51 (not illustrated). The sealed pipes 780 are provided in plural numbers (that is, the sealed spaces inside-pipe S780 are provided in plural numbers). The sealed pipes 780 have a shape of straight line, and extend in parallel with the axial direction A. The plural sealed pipes 780 are disposed (arranged) so as to cover the entire (or substantially entire) side face 23*s* of the muffler 20. Each of the plural sealed pipes 780 is provided with the valve 570, for example, on the end part in the axial direction.

(Effect 7-2)

Effects by the muffler sound-insulation structure 701 shown in FIG. 11 (*b*) will be described. The muffler sound-insulation structure 701 comprises the sealed spaces inside-pipes S780 (sealed space) disposed between the outer face of the soundproof cover 30 (surface of the outer wall 33*s*) and the muffler 20.

[Structure 7-2]

A pressure of the sealed spaces inside-pipe S780 is depressurized relative to an air pressure outside the soundproof cover 30.

According to the above [Structure 7-2], a sound wave is hard to be transmitted in the sealed spaces inside-pipe S780. Thus, it is possible to improve the sound-insulation property of the muffler sound-insulation structure 701.

(Effect 8-2)

Pressure inside the sealed spaces inside-pipe S780 is 0.05 MPa or less. In this structure, it is possible to surely improve the sound-insulation property by the sealed spaces inside-pipe S780.

(Other Effects by Sealed Pipe 780)

The sealing space (the sealed space inside-pipe S780) is formed inside each sealed pipe 780. According to this structure, it is possible to easily form the sealing space (the sealed space inside-pipe S780). More specifically, in order to form the sealed spaces inside-covers S530 of the fifth embodiment shown in FIG. 8 (*b*), it is necessary to join the inner side wall 333*i*, the outer wall 333*o*, and the connecting walls 333*r* without a gap. On the other hand, to form the sealed space inside-pipe S780 of the present embodiment, it is only necessary to form the sealed pipe 780 by closing the both ends in the axial direction of the tubular member.

(Modification)

The above each embodiment may be variously modified. For example, a part of the each embodiment above may be combined to another.

For example, it is possible to appropriately combine the structures provided between the muffler main body portion 23 as described in FIG. 2 (*b*), etc. and the soundproof cover 30/330 (which will be referred to as structures α). For example, it is possible to appropriately combine the rib 225 shown in FIG. 5 (*a*), the glass wool 361 shown in FIG. 6 (*b*), the sealed pipe 780 shown in FIG. 11 (*b*), or the like. For example, the sealed pipes 780 may be provided inside or outside the glass wool 361 shown in FIG. 6 (*b*) in the radial direction R.

It is also possible, for example, to appropriately combine the soundproof cover 30 as shown in FIG. 2 (*b*) (which can be called as a single structure), or the soundproof cover 330 in a double structure as shown in FIG. 6 (*b*) (the above single or double structure will be referred to as structure β). For example, the soundproof cover 330 of the fifth embodiment shown in FIG. 8 (*b*) (which comprises the sealed space inside-covers S530) may be provided to inside or outside in the radial direction R of the soundproof cover 330 of the third embodiment shown in FIG. 6 (*b*) (in which the glass wool 361 is provided inside the space inside-covers S330).

It is also possible, for example, to appropriately combine the structure α and the structure β above.

Although the present invention has been described in detail and with reference to the specific embodiments, it is apparent for those skilled in the art that various modifications or alterations can be added thereto without departing from the spirit and the scope of the present invention.

The present application is based on the Japanese patent application (Patent Appl. No. 2013-097805) filed on May 7, 2013, the contents thereof being incorporated herein by reference.

EXPLANATION OF REFERENCE NUMERALS

1, 201, 301, 401, 501, 601, 701: Muffler sound-insulation structures
10: Pipe
20: Muffler
30, 330: Soundproof covers
31R, 31L: Unit soundproof covers
35: Connecting part
40: Putty
51: Rock wool tape (porous material)
333*i*: Inner wall
333*o*: Outer wall
361: Glass wool (porous material)
363, 457: Granules
455: Bag
A: Axial direction
F: Fluid
S330: Space inside-covers
S530: Sealed space inside-covers (sealed space)
S780: Sealed space inside-pipe (sealed space)

The invention claimed is:

1. A muffler sound-insulation structure comprising a muffler having an outer surface, extending in an axial direction, through which a fluid flows inside, a soundproof cover having an inner surface which encloses said muffler in a state of non-contact to said muffler, and a plurality of ring-shaped heat insulators provided spaced apart from each other along the axial direction between the outer surface of the muffler and the inner surface of the soundproof cover;

wherein said soundproof cover is formed so as to have a circumferential cross section when viewed from said axial direction, and is configured to be disassemblable;

said soundproof cover comprises plural unit soundproof covers each constituting a portion of said circumferential cross section, and a connecting part which is provided on the periphery of said circumferential cross section and connect said plural unit soundproof covers with one another in an attachable/detachable manner; and each of said plural unit soundproof covers is configured so as to be capable of being attached and detached relative to said muffler by being moved in a direction orthogonal to said axial direction of said muffler.

2. The muffler sound-insulation structure according to claim 1, which comprises a pipe through which said fluid flows inside, connected to said muffler, and a putty which fills a gap between said pipe and said soundproof cover.

3. The muffler sound-insulation structure according to claim 1, which comprises a porous material provided between said muffler and said soundproof cover.

4. The muffler sound-insulation structure according to claim 1, wherein said soundproof cover comprises an inner wall, an outer wall which is provided in a side more distant to said muffler than said inner wall is, a space inside-covers which is formed between said inner wall and said outer wall, and a porous material provided inside said space inside-covers.

5. The muffler sound-insulation structure according to claim 1, wherein said soundproof cover comprises an inner wall, an outer wall which is provided in a side more distant to said muffler than said inner wall is, a space inside-covers which is formed between said inner wall and said outer wall, and granules provided inside said space inside-covers.

6. The muffler sound-insulation structure according to claim 1, which comprises a bag provided between said muffler and said soundproof cover, and granules provided inside said bag.

7. The muffler sound-insulation structure according to claim 1, comprising a sealed space disposed between an outer face of said soundproof cover and said muffler, wherein a pressure of said sealed space is depressurized relative to an air pressure outside said soundproof cover.

8. The muffler sound-insulation structure according to claim 7, wherein the pressure in said sealed space is 0.05 MPa or less.

9. The muffler sound-insulation structure according to claim 1, wherein said heat insulators are made of porous material.

10. The muffler sound-insulation structure according to claim 1, wherein each of said heat insulators is in a form of rock wool tape which is wound around the outer surface of the muffler and is in contact with the inner surface of the soundproof cover so that the rock wool tapes fix the soundproof cover onto the muffler.

* * * * *